US006988553B2

(12) United States Patent
DeBerry

(10) Patent No.: US 6,988,553 B2
(45) Date of Patent: Jan. 24, 2006

(54) HORIZONTAL SPOOL TREE WELLHEAD SYSTEM AND METHOD

(75) Inventor: Blake T. DeBerry, Singapore (SG)

(73) Assignee: Dril-Quip, Inc., Houston, TX (US)

( * ) Notice: Subject to any disclaimer, the term of this patent is extended or adjusted under 35 U.S.C. 154(b) by 1 day.

(21) Appl. No.: 10/872,673

(22) Filed: Jun. 21, 2004

(65) Prior Publication Data

US 2004/0262009 A1 Dec. 30, 2004

Related U.S. Application Data

(62) Division of application No. 10/222,259, filed on Aug. 16, 2002, now Pat. No. 6,805,200.

(60) Provisional application No. 60/313,612, filed on Aug. 20, 2001.

(51) Int. Cl.
*E21B 29/12* (2006.01)

(52) U.S. Cl. ..... 166/347; 166/348; 166/382; 175/5

(58) Field of Classification Search ..... 166/368, 166/348, 382, 339, 341, 347, 88.4, 95.1; 175/7, 8, 9
See application file for complete search history.

(56) References Cited

U.S. PATENT DOCUMENTS 3,653,435 A * 4/1972 Reistle et al. ..... 166/366
4,216,834 A * 8/1980 Wardlaw ..... 175/7
4,886,121 A * 12/1989 Demny et al. ..... 166/382
5,465,794 A 11/1995 McConaughy et al.
5,544,707 A 8/1996 Hopper et al.
5,555,935 A 9/1996 Brammer et al.
6,039,119 A 3/2000 Hopper et al.
6,062,314 A 5/2000 Nobileau
6,227,300 B1 * 5/2001 Cunningham et al. ..... 166/339
6,457,530 B1 * 10/2002 Lam et al. ..... 166/368
6,755,254 B2 * 6/2004 DeBerry ..... 166/368
6,796,381 B2 * 9/2004 Ayler et al. ..... 166/387

* cited by examiner

*Primary Examiner*—Frank S. Tsay

*Assistant Examiner*—Thomas A Beach

(74) *Attorney, Agent, or Firm*—Browning Bushman P.C.

(57) ABSTRACT

A horizontal spool tree wellhead system 10 utilizes a casing 18, 19 installed in a well bore and a wellhead housing 20 at the upper end of the casing. A spool 23 of the horizontal tree 22 is connected to the upper end of the wellhead housing, and includes at least one radially extending side port. The BOP 28 is also installed at the upper end of the housing with a bore aligned with the wellhead housing bore. After drilling the well, the casing string 19 carrying a casing hanger 42 may be lowered through the bores of the BOP, the spool tree, and the wellhead housing and into the well. An orientation/isolation sleeve 60 may be installed in a predetermined rotational orientation with the spool tree. A tubing hanger 70 having a side port is landed onto the orientation sleeve and is automatically oriented to align the tubing hanger side port with the spool side port.

16 Claims, 4 Drawing Sheets

HORIZONTAL SPOOL TREE WELLHEAD SYSTEM AND METHOD

CROSS REFERENCE TO RELATED APPLICATIONS

This application is a divisional of U.S. patent application Ser. No. 10/222,259 filed Aug. 16, 2002, now U.S. Pat. No. 6,805,200, which claims the benefit of the provisional application U.S. patent application Ser. No. 60/313,612 filed Aug. 20, 2001.

FIELD OF THE INVENTION

This invention relates generally to a subsea wellhead system for use in the drilling and completion of oil or gas wells at substantial depths beneath the water surface and, more particularly, to a wellhead system with a horizontal spool tree.

BACKGROUND OF THE INVENTION

Conventional wellhead system includes a wellhead housing mounted on the upper end of a subsurface casing string extending into the well bore. A riser and blowout preventer (BOP) are then installed. During the drilling procedure, the BOP is installed above a wellhead housing (casing head) to provide pressure control as casing is installed, with each casing string having a hanger on its upper end for landing on a shoulder within the wellhead housing. Upon completion of this process, the BOP is replaced by a Christmas tree installed above the wellhead housing, with the tree having a valve to enable the oil or gas to be produced and directed into flow lines for transportation to a desired facility.

In accordance with a relatively recent development in this field, the conventional casing and tubing heads making up the Christmas tree are replaced by a horizontal tree which comprises a spool with a generally horizontal through port mounted above and in axial alignment with a horizontal through port in the wellhead housing. In this application, the hangers for the casing strings are supported one above the other within the bore of the wellhead housing, and the tubing hanger for the production or tubing string is supported in the bore of the spool to suspend the production string within the casing strings.

The vertical bore through the tubing hanger of a horizontal tree may be closed by a wire line tool to direct production fluid through aligned side ports (generally horizontal through ports) in the hanger and spool for recovery and delivery of production fluid to a suitable location. A redundant seal may be provided by a well cap installed in the tree above the tubing hanger, with the vertical bore aligned with that of the tubing hanger closed by a wire line plug to permit vertical access to the production tubing string upon removal of the plug.

The completion of a well with a horizontal tree conventionally includes an isolation/orientation sleeve which is installed within the tree bore in order to isolate and thus allow testing from the exterior of a metal seal between the adjacent ends of the wellhead housing and spool. A portion of the sleeve also carries a guide tube with an upwardly contoured guide surface positioned to cooperate with a lug on the tubing hanger to rotate the tubing hanger into a desired position as it is lowered onto a shoulder in the bore of the spool. This technique automatically aligns the side port in the hanger with the side port in the tree bore.

A BOP stack then is lowered onto the upper end of the spool with a bore in alignment with the spool bore, and a tubing hanger then lowered through the BOP and into the spool bore. A lug on the lower end of the hanger cooperates with the guide surface to orient the hanger into a proper landed position on a seat in the bore of the spool. A tree cap is then lowered into a landed position, following which the BOP may be removed to permit installation of a cover on the top of the tree.

More particularly, the complete drilling and completion operation involves lowering a wellhead housing at the upper end of a production casing string onto an outer housing at the upper end of a conductor casing surrounding the production casing string. The conductor casing and housing at its upper end conventionally have been lowered onto the ocean floor to suspend the production casing string within a well bore by means of a permanent base having guide posts, using cables extending to the surface.

The wellhead housing is lowered with the casing by a running tool on a drill pipe into the upper end of a BOP whose lower end is connected to the wellhead housing by means of a releasable connector, with the bores of the wellhead housing, the BOP and drill pipe in axial alignment. The BOP is normally of the ram type well known in the art and having a stack including at least one pipe ram and at least one blind ram. The upper outer diameter of the wellhead housing may have grooves thereabout to receive teeth of the releasable latch of the connector.

An outer casing hanger on the upper end of the casing may be lowered for landing onto a shoulder in the bore of the wellhead housing to suspend it within the conductor casing. An inner casing hanger in turn may be lowered into a landed position on the outer casing hanger to suspend an inner production casing within the casing. The hangers and the strings on which they are mounted may thus be lowered into the well on running strings through the riser and BOP bore.

A wear bushing may then be lowered through the riser and BOP for landing with its bore aligned with that of the casing hanger and extending upwardly within the bore of the wellhead housing so as to prevent wear on the seal at the upper bore of the wellhead housing during drilling of the production well. The lower portion of this bore is aligned with the bore of the upper casing hanger, while the upper end is enlarged to provide a tapered seat at its lower end. Each of the casing hangers and the wear bushings are releasably locked in place and the outer diameters of the hangers are sealed with respect to the bore of the wellhead housing.

At this stage, the wear bushing may be raised by a suitable running tool, and the BOP and connector at its lower end are released from the upper end of the wellhead housing and raised to the surface to enable the spool of a horizontal tree to be lowered on a running tool releasably connected to its upper end. The tree may then be guidably lowered onto the upper end of the wellhead housing by means of sleeves lowered over the guide posts. The tree may be releasably connected at its lower end to the upper end of the wellhead housing. Thus, the connector has latches on its lower end which move over the upper end of the housing for locking thereto with their bores aligned.

Upon landing of the horizontal tree on the wellhead housing, a lower end of an orientation sleeve in the tree moves into the upper enlarged end of the casing hanger to form a continuation of the bore therethrough. This lower end of the orientation sleeve carries a seal assembly for sealing between it and the upper enlarged bore of the casing hanger. A seal which was lowered with the upper casing hanger seals off the annulus between the casing hanger and well bore housing. A metal seal ring is carried by the tree to land upon and form a seal with a tapered seat on the inner diameter of the upper end of the bore of the housing so as to be energized as the tree is connected to the housing by a connector.

The upper portion of the bore through the horizontal tree may be enlarged to receive an elongated wear bushing which is lowered with the tree to land on an intermediate shoulder in the upper enlarged bore of the tree. The wear bushing has an inner diameter somewhat less than that of the bore of the tree so as to prevent wear on the seal surfaces of the tree bore as tools are lowered into and raised from the well bore during drilling of the hole to receive the tubing.

In accordance with one of its functions, the sleeve isolates the metal seal ring to permit the ring to be tested from the outside of the tree. In addition, the sleeve has an upwardly extending guide surface which cooperates with a lower guide surface on a tubing hanger to orient the tubing hanger into a desired rotational position as it is lowered into the tree bore. Thus, for horizontal trees of this type, a side port in the tubing hanger is aligned with side port in the tree to direct production fluid to a flow line.

In accordance with horizontal tree practices, a first plug is lowered on a wire line and locked within the upper end of the hanger bore above its side port, and a tree cap that may contain another wire line plug is lowered into and locked within the bore of the tree. The BOP is then removed and replaced by a protective cover which is axially aligned and rotationally oriented into a position over the upper end of the tree.

The conventional procedure for installing a horizontal tree on a subsea wellhead involves the installation and the removal, and the subsequent reinstallation, of the BOP stack. U.S. Pat. Nos. 5,465,794; 5,544,707; 5,555,935; 6,062,314 and 6,039,119 disclose different equipment for horizontal tree applications. Each such installation is time consuming and expensive.

The present invention provides an improved horizontal spool tree wellhead system and method in which only one installation of the BOP stack is required. The disadvantages of the prior art are overcome by the present invention, and improved horizontal spool tree wellhead system and method are hereinafter disclosed which does not require repeated installation and removal of the BOP stack.

SUMMARY OF THE INVENTION

According to the method of invention, a subsea well is drilled and completed with a casing installed in the well bore and a wellhead housing having a wellhead housing bore installed on the upper end of the casing. The method includes lowering a spool of a horizontal tree for connection with an upper end of the wellhead housing, with the spool having a spool bore and at least one spool side port extending radially from the spool bore. A BOP may then be installed on the upper end of the tree, with the BOP having a BOP bore aligned with a spool bore and the wellhead housing bore. After a large diameter hole has been drilled with the tree and BOP in place, a casing string carrying a casing hanger may be lowered through the bores of the BOP, the spool tree and the wellhead housing and into the large diameter hole. At least one production hole with a smaller diameter may then be drilled with the drill string extending through the tree and the BOP on the wellhead. An orientation/isolation sleeve may then be installed in the tree spool, with the sleeve having a predetermined rotational orientation with the spool tree. Thereafter, a tubing hanger having a side port extending radially from the tubing hanger central bore may be lowered for landing on the orientation sleeve and rotationally oriented by the sleeve to align the tubing hanger side port with the spool side port.

According to the system of the present invention for drilling and completing a subsea well, a horizontal spool tree includes a spool bore and at least one side port extending radially from the spool bore. A BOP bore is aligned with the spool bore and the wellhead housing bore, and a casing string is supported on a casing hanger from the bore within the wellhead housing. An orientation sleeve may then be installed with a predetermined rotational orientation with respect to the spool tree, with the orientation sleeve having an internal diameter less than the cutting diameter of the drill bit used to drill the production hole. A tubing hanger is then landed on the orientation sleeve, as discussed above, so that its side port is oriented properly with respect to the spool side port.

The significant feature of the invention is that the size of the drill bit for drilling the large diameter hole is not restricted by the tree bore, which may be the full bore of the wellhead. A drill bit at the end of a drill string passes through the BOP through the tree and wellhead housing, and into the formation to drill the casing hole. Also, the size of the bit used to drill the production hole need not be restricted by the orientation sleeve. The orientation sleeve may have an internal diameter substantially less than the cutting diameter of the drill bit used to drill the production hole, since the orientation sleeve is installed after drilling the production well. A sleeve-shaped subsea tree bore protector may be provided within the bore of the tree while drilling the well, and may be removed prior to installing the orientation/isolation sleeve.

A further feature of the invention is that the orientation/isolation sleeve seals at its lower end to a casing hanger and its upper end to the tree. This sleeve preferably includes an upper guide surface for engagement with the tubing hanger to orient the tubing hanger with respect to the tree. The orientation sleeve also is preferably fixed to the tree to resist vertical and rotational forces applied to the orientation/isolation sleeve.

The tubing hanger preferably includes a fluid production port which extends laterally from the central tubing hanger bore for producing fluids from production tubing extending from the tubing hanger into the production well. During completion, an internal tree cap may be positioned above the production tubing hanger and secured to the tree. One plug may be positioned within a central bore of the tubing hanger, and another plug positioned within a central bore of the tree cap.

The casing hanger is preferably landed on a shoulder within the wellhead housing. The orientation sleeve preferably extends from within the wellhead housing into the spool bore of the horizontal tree, while the tubing hanger is positioned within the spool bore of the tree and is supported on the orientation sleeve. A conventional BOP stack may thus be used above the tree.

These and further objects, features, and advantages of the present invention will become apparent from the following detailed description, wherein reference is made to the figures in the accompanying drawings.

BRIEF DESCRIPTION OF THE DRAWINGS

FIG. 1 illustrates a horizontal spool tree wellhead system according to the present invention, with a tree as shown in dashed lines installed on a wellhead housing, and a BOP stack shown in dashed lines positioned above the tree. Conventional tree components and the BOP stack are thus illustrated in dashed lines, with a drill-through tree bore protector lining an interior of the bore through the tree.

FIG. 2 illustrates an outer casing hanger landed in the wellhead housing, and an inner casing hanger landed on the outer casing hanger, with both hangers being positioned within the wellhead housing. Each hanger supports a respective casing which extends downward into the well.

FIG. 3 illustrates an orientation/isolation sleeve installed on the inner casing hanger, with the isolation sleeve including a tapered upper guide surface.

FIG. 4 shows a tubing hanger landed on the isolation sleeve and oriented with respect to the tree by the upper guide surface on the orientation/isolation sleeve.

DETAILED DESCRIPTION OF PREFERRED EMBODIMENTS

Figure 1:
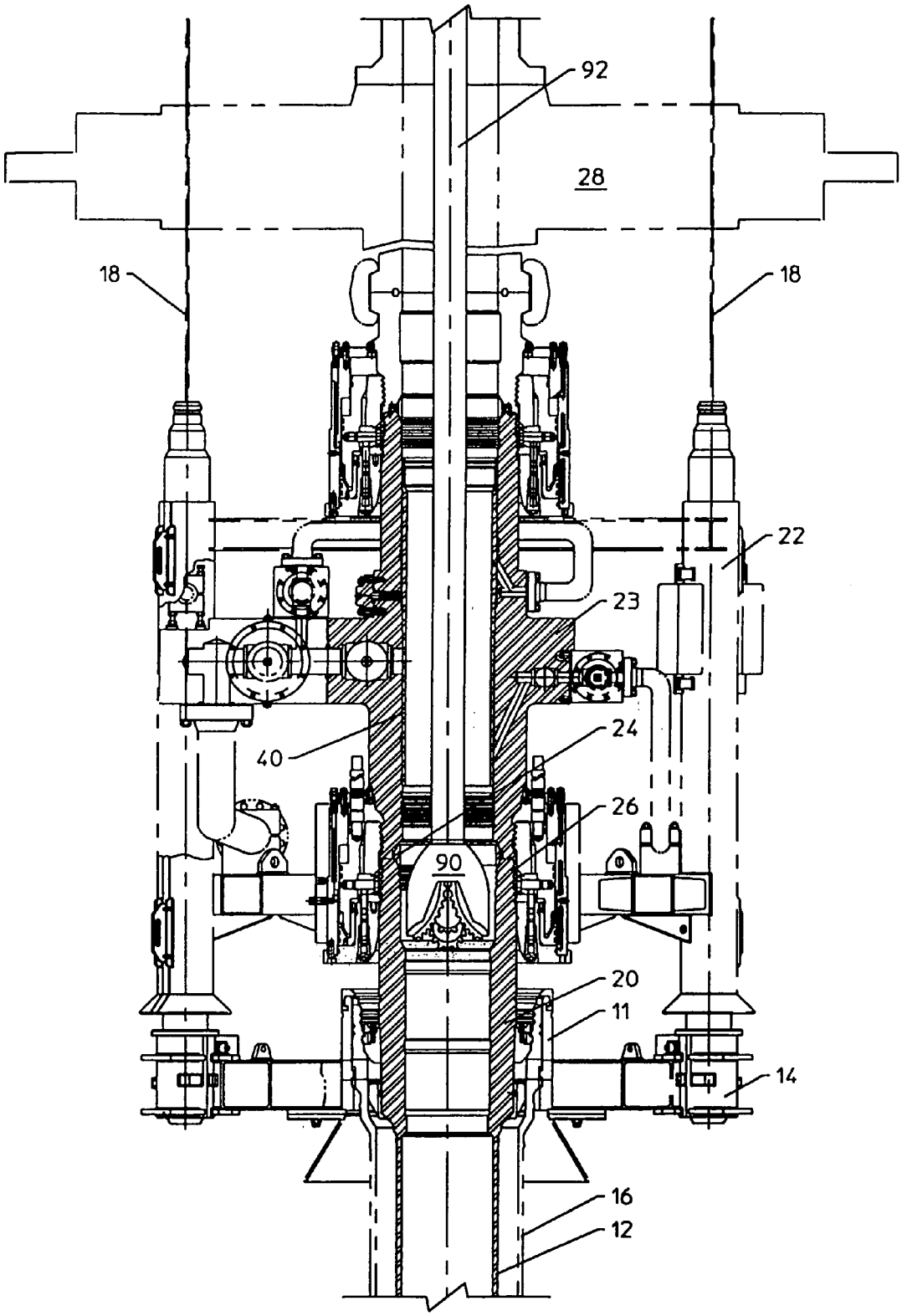
FIGS. 1–4 illustrate the improved procedure in accordance with this invention for drilling and completing a well. In the figures, the steps of the procedure are numbered sequentially.

FIG. 1 illustrates the first stage of operation with the improved system in accordance with the present invention, wherein a horizontal tree 22 has been guidably lowered on a running tool (not shown) onto the upper end of the wellhead housing 20. When so lowered, the tree 22 is releasably connected with the upper end of the wellhead housing 20 by a connector 26. A metal seal ring 24 carried in the lower end of the bore lands upon a taper on the upper end of the housing 20, and is caused to seal with the tree 22 upon makeup through the subsea connector 26. As shown in FIG. 1, an outer casing 16 may be supported on an outer casing housing 11, which in turn is fixed to the guide base 14 configured for landing the tree 22 onto the guide base. The inner casing 12 is supported on the inner casing housing 20 discussed above. Conventional tether lines 18 may be used for lowering and landing the tree 22 onto the guide base 14.

Figure 2:
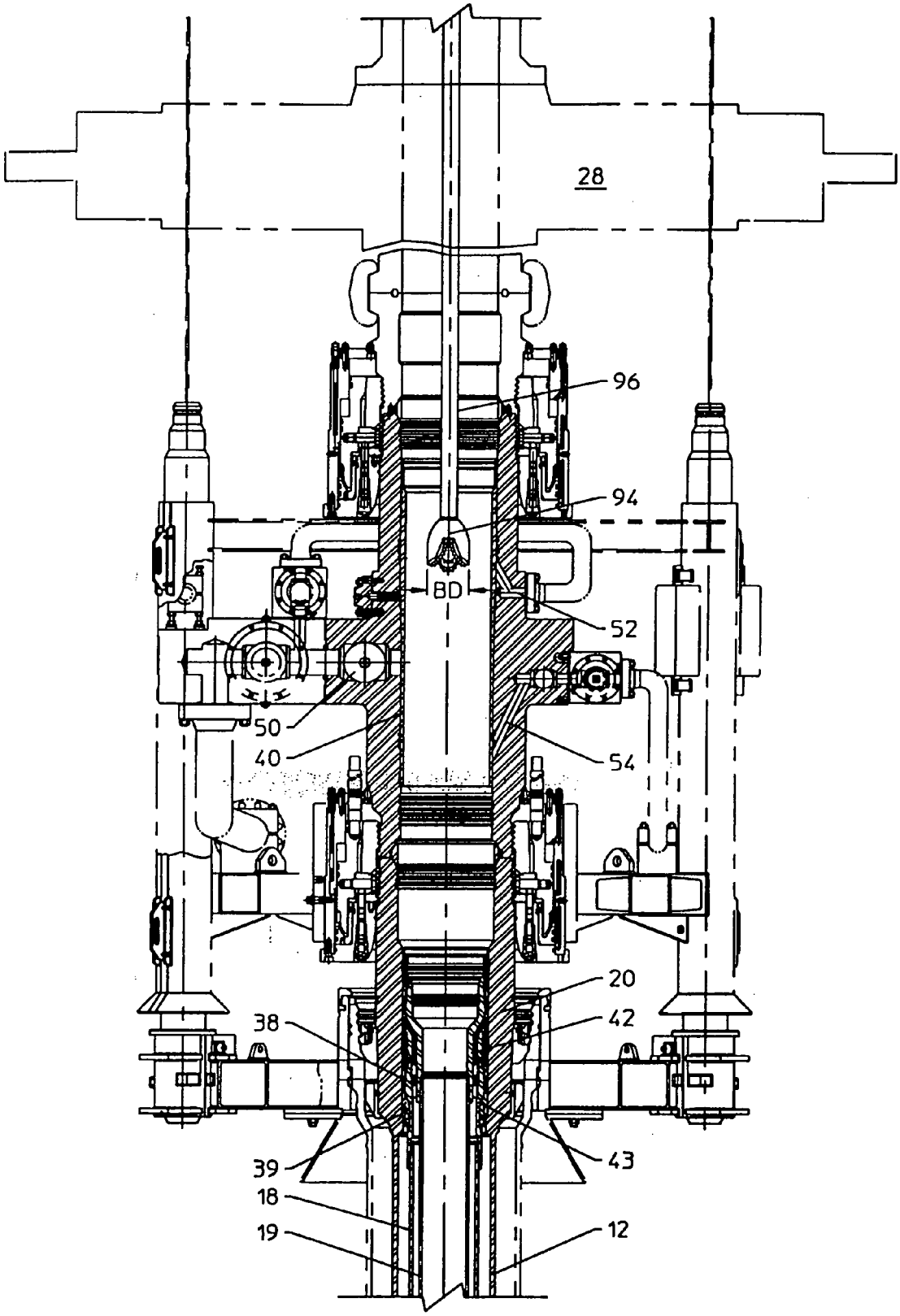

Referring still to FIG. 1, the running tool has been removed and a BOP stack 28 has been lowered onto the upper end of the tree 22 for releasable connection thereto by means of another releasable connector. At this time, the system is prepared for drilling therethrough, with the outer casing 10 and the inner casing 12 suspended within the well bore. For this purpose, the bore at the upper end of the tree is preferably protected by a protector sleeve 40 landed and held down on a shoulder of the tree. The large diameter hole which subsequently may receive the casing strings 18 and 19, as shown in FIG. 2, may thus be drilled into a subsea formation with a large diameter bit 90 as shown in FIG. 1 at the lower end of drill string 92. The bit 90 may have a cutting diameter which is only slightly less than the internal diameter of the housing 20, since the bore through the tree 22 preferably is at least as large as the most restrictive bore through wellhead 20.

After drilling of the large diameter hole, a casing hanger 38, as shown in FIG. 2 for supporting the casing string 18 may be landed on a shoulder 39 in the bore of the housing 20, and a hanger 42 for the inner casing string 19 may be landed on the hanger 38, or alternatively the hanger 42 may land on the hanger 38 and/or a shoulder on housing 20. With the BOP and drilling riser still in place, a wear bushing (not shown) having a diameter less than the sleeve 40 may be lowered on a running tool into the bore of the tree and landed on the upper end of the hanger 42 for axial extension through the bore of the tree and into the bore of the housing 20. The lower end of the wear bushing may fit closely within and seal with the enlarged upper end of the upper casing hanger 42. In this position, the wear bushing, like the protector sleeve 40, covers the production port 50 in the left side of the spool 23, and the upper and lower ports 52, 54 in the right side of the tree spool.

Figure 3:
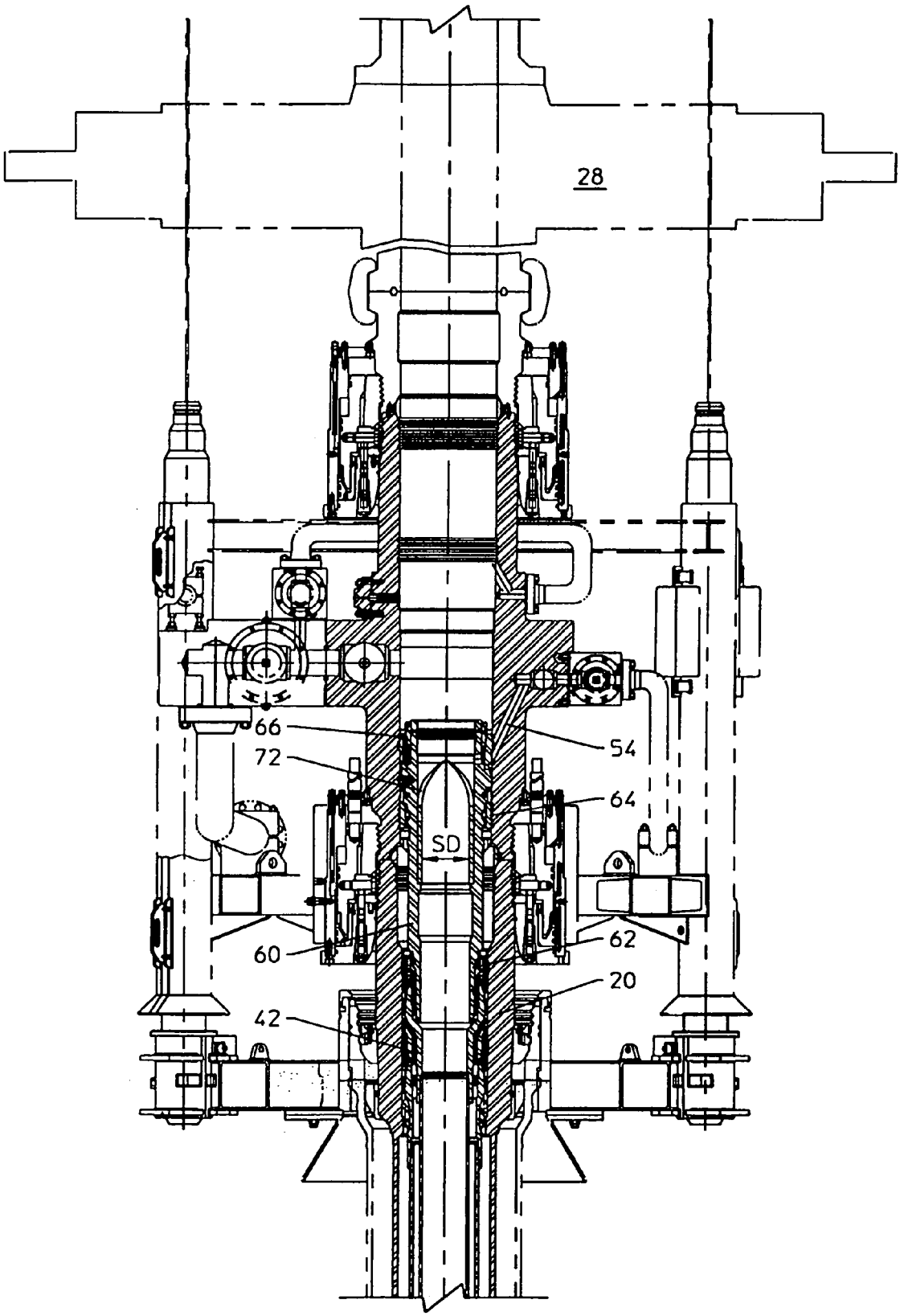

Following drilling of another hole to receive a production tubing string, the wear bushing and the protector sleeve 40 are removed, as shown in FIG. 3. With the BOP and drilling riser still in place, an orientation/isolation sleeve 60 is then lowered into the bore of the tree 22 and oriented, landed and locked down to the tree above the upper casing hanger 42, as shown in FIG. 3. Various mechanisms may be used to orient the sleeve 60 with respect to the tree 22, including an orientation key on the sleeve that fits within a groove in the casing hanger 42. A lower extension 62 of the sleeve 60 extends into and is locked to the enlarged upper end of the upper casing hanger 42, while the upper end 64 of the sleeve seals with the tree spool 23. In this position, the orientation sleeve 60 thus seals with the bores of the tree and wellhead housing to isolate the metal seal ring 24 and thus provide two pressure barriers. One or more lock down mechanisms 66 may be used to axially secure the orientation sleeve to the spool 23.

Figure 4:
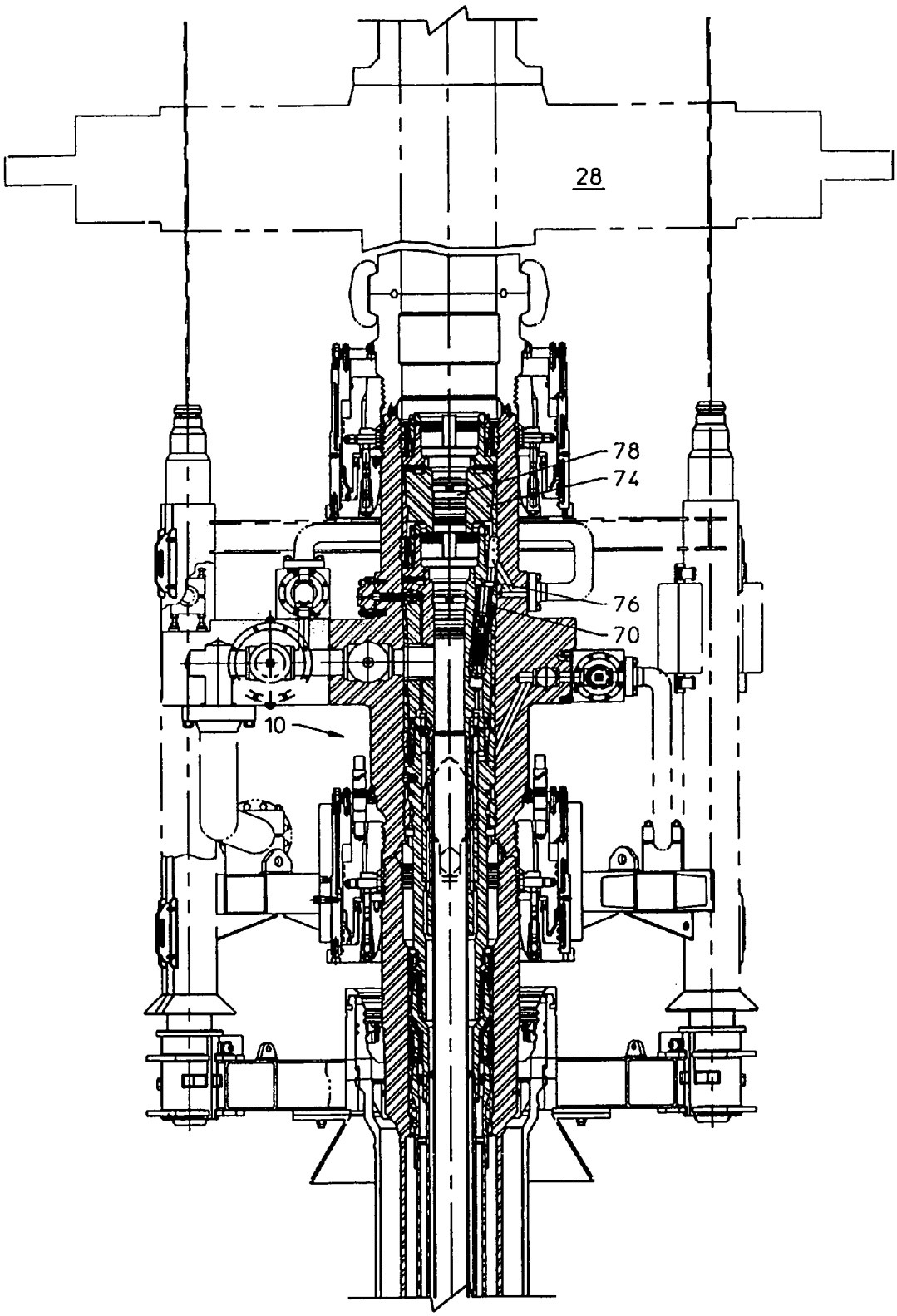

The upper end 64 of the orientation sleeve 60 does not block access to the side ports 52, 54 in the tree bore, so that a production tubing hanger 70, as shown in FIG. 4, may be lowered through the drilling riser and the BOP 28 to land on the upper end of the orientation/isolation sleeve 60, as shown in FIG. 4, in which position a key or lug on the upper tubing hanger engages the tapered guide surface 72 on the orientation sleeve 60, so that the key moves into a vertical locking slot in the sleeve 60. In this position, a shoulder on the tubing hanger lands on a shoulder of the sleeve 60 and is held down in the bore of the tree 22.

A production tubing will thus be suspended from the tubing hanger 70 and passed through the orientation/isolation sleeve 60 and into the production well bore. More particularly, the drilling and completion system has reached the same stage as discussed above in connection with the prior art without having to remove the BOP and drilling riser.

The well may thus be completed in essentially the same way as described above. A tree cap 74, as shown in FIG. 4, has been lowered through the riser and BOP and installed in the tree bore above the tubing hanger, with its bore aligned with that of the tubing hanger of the subsea tree. Plugs 76 and 78 are installed in the tree cap and bore of the upper tubing hanger. The completed assembly 10 is thus shown in FIG. 4. The riser and BOP may then be removed, and the upper end of the bore of the subsea horizontal tree 22 closed by the protective cover.

The tree 22 and spool 23 may include one or more side ports leading to various conduits and controlled by valves to permit various workover tests and other functions to be performed, as shown and described in U.S. Pat. No. 5,544,707. Alternatively, the tree may be constructed in accordance with one or more of those shown and described in provisional application Ser. No. 60/295,857, entitled "HORIZONTAL TREE," filed May 25, 2001, and in utility application Ser. No. 10/155,482 filed May 24, 2002, entitled "HORIZONTAL SPOOL TREE ASSEMBLY." Thus, the tree 22 may have different conduit connections with its side port or ports. From the descriptions of the present invention as discussed above, its advantages are attained regardless of the type of horizontal tree.

A significant advantage of this invention is that the bore through the horizontal spool of the tree may be at least as large as the most restrictive diameter of the bore through the wellhead. Accordingly, the size of the large diameter well is only restricted by the bore size of the wellhead, even though the tree is already in place on the wellhead when drilling this large diameter well. The maximum bore of the tree is thus significantly greater than the bore through the one or more casing hangers, which is unlike the prior art operation wherein the BOP was removed and the tree first installed after the casing hangers were hung in the well.

Another significant advantage of the present invention is that the orientation/isolation sleeve need not be installed until just prior to running the tubing string in the well, and after drilling the portion of the hole intended to receive this tubing string. Accordingly, the bore through the tree is not restricted by an orientation/isolation sleeve while the production tubing well is being drilled. By running the sleeve in after the drilling operation is complete, a highly reliable orientation/isolation sleeve may be used. The present invention thus makes possible the drilling of a production well for receiving the production tubing string wherein the bit diameter used to drill the production hole is not restricted, and may be only slightly less than the diameter of the casing hanger, and only slightly less than the diameter of a protector sleeve provided within the spool 23. Referring to FIGS. 2 and 3, for example, FIG. 2 depicts a bit 94 suspended on a drill string 96 which may be passed through the tree 22 and through the casing hangers 38 and 42 to drill a production hole. The cutting diameter or bit diameter BD of the bit 94 as shown in FIG. 2 may thus be greater than the bore diameter SD of the orientation sleeve 60 as shown in FIG. 3, which again is not possible in the prior art technique since the orientation sleeve was installed with the tree before drilling the production hole.

The orientation/isolation sleeve as disclosed herein may be a single sleeve that achieves three purposes: (1) sealing between the casing hanger (or the wellhead) and the tree, (2) providing orientation for the tubing hanger so that the side port of the tubing hanger is properly oriented with respect to the side port in the spool, and (3) securing the orientation sleeve to the tree to resist vertical forces, either upward or downward, that may be imparted to the orientation sleeve. If desired, separate components could be used to perform each of these functions. Orientation of the tubing hanger could be achieved with a device separate from the function of sealing between the casing hanger and the tree. In many applications, it will be desirable to lock the sleeve to the tree, although in other applications the sleeve could be locked to the wellhead housing, or could be axially fixed between the casing hanger locked to the wellhead housing and the tubing hanger locked to the tree. In most applications, other functions of the orientation/isolation sleeve are to support the weight of the tubing hanger and thus the tubing string, and to safely withstand the fluid pressure levels in the tree.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method of drilling and completing a subsea production well with a casing installed in the wellbore and a wellhead housing having wellhead housing bore installed on the upper end of the casing, the method comprising:

lowering a spool of a tree into connection with an upper end the wellhead housing, the spool having a spool bore along substantially its axial length greater than the wellhead housing bore below the spool;

installing a BOP at the upper end of the spool, the BOP having a BOP bore aligned with the spool bore and the wellhead housing bore;

drilling a first hole with a first bit having first cutting diameter by passing the first bit through the BOP and the spool;

lowering a casing string carrying a casing hanger through the bores of the BOP and the spool tree and landing the casing hanger in the bore of the wellhead housing;

drilling a second hole with a second bit having a second cutting diameter less than the first cutting diameter by passing the second bit through the BOP, the tree spool, and at least a portion of the casing string;

positioning a sleeve-shaped subsea tree bore protector within the bore of the spool when drilling one of the first hole and the second hole; and lowering a tubing string carrying a tubing hanger through the bore of the BOP, and landing the tubing hanger in the bore of the spool.

2. The method of drilling and completing a subsea production well as defined in claim 1, further comprising:

lowering a second casing string carrying a second casing hanger through the bores of the BOP and the spool tree, and landing the second casing hanger on the casing hanger.

3. The method of drilling and completing a subsea production well as defined in claim 1, further comprising:

landing the tubing hanger at an upper end of the protector.

4. A method of drilling and completing a subsea production well as defined in claim 1, wherein the casing hanger is landed on a shoulder within the wellhead housing.

5. A system for drilling and completing a subsea production well with a casing installed in the well bore and a wellhead housing having a wellhead housing bore installed on the upper end of the casing, the system comprising:

a spool of a tree connected with an upper end of the wellhead housing, the spool having a spool bore along substantially its axial length greater than the wellhead housing bore below the spool;

a BOP connected with the upper end of the spool and having BOP bore aligned with the spool bore and the wellhead housing bore;

a first casing string supported on a first casing hanger landed on a shoulder within the bore of the wellhead housing;

a second casing string supported on a second casing hanger landed on the first casing hanger within the bore of the wellhead housing;

a tubing string supported on a tubing hanger landed within the spool bore; and a sleeve-shaped subsea bore protector within the bore of the spool prior to positioning the tubing hanger within the spool bore.

6. A system for drilling and completing a subsea production well as defined in claim 5, further comprising:

the protector extending upward from the second casing hanger, the tubing hanger landed within the spool bore at an upper end of the protector.

7. A system for drilling and completing a subsea production well as defined in claim 5, further comprising:

an internal tree cap positioned above the tubing hanger and secured to the spool.

8. A system for drilling and completing a subsea production well as defined in claim 5, further comprising:

a lower seal for sealing between the protector and the casing hanger; and an upper seal for sealing between the protector and the spool.

9. A system for drilling and completing a subsea production well as defined in claim 5, further comprising:

the protector including an orientation sleeve between the wellhead housing and the spool, the orientation sleeve having a predetermined rotational orientation with the spool and an internal diameter less than the cutting diameter of the drill bit; and a tubing hanger having a side port extending radially from a tubing hanger central bore for landing on the orientation sleeve and rotationally oriented by the orientation sleeve to align the tubing hanger side port with the spool side port.

10. A system for drilling and completing a subsea production well with a casing installed in the well bore and a wellhead housing having a wellhead housing bore installed on the upper end of the casing, the drilling operation including drilling a hole with a drill bit having a cutting diameter, the system comprising:

a horizontal spool tree connected with an upper end of the wellhead housing, the spool tree having a spool with a spool bore and at least one spool side port extending radially from the spool bore;

a BOP connected with the upper end of the spool and having BOP bore aligned with the spool bore and the wellhead housing bore;

a sleeve-shaped subsea tree bore protector within the bore of the tree for protecting the spool tree while drilling the hole;

a first casing string supported on a first casing hanger landed on a shoulder within the bore of the wellhead housing;

a second casing string supported on a second casing hanger landed on the first casing hanger within the bore of the wellhead housing; and a tubing string supported on a tubing hanger landed within the spool bore, the tubing hanger having a side port extending radially from a tubing hanger bore and in fluid communication with the spool side port.

11. A system for drilling and completing a subsea production well as defined in claim 9, further comprising:

another sleeve extending upward from the second casing hanger, the tubing hanger landed within the spool bore at an upper end of the another sleeve.

12. A system for drilling and completing a subsea production well as defined in claim 9, further comprising:

the sleeve-shaped subsea bore protector is positioned within the bore of the spool prior to positioning the tubing hanger within the spool bore.

13. A system for drilling and completing a subsea production well as defined in claim 9, further comprising:

an internal tree cap positioned above the tubing hanger and secured to the spool.

14. A system for drilling and completing a subsea production well as defined in claim 13, further comprising:

at least one plug within the central tubing hanger bore; and another plug within a central bore of the tree cap.

15. A system for drilling and completing a subsea production well as defined in claim 9, further comprising:

an orientation sleeve between the wellhead housing and the spool, the orientation sleeve having a predetermined rotational orientation with the spool and an internal diameter less than the cutting diameter of the drill bit; and a tubing hanger having a side port extending radially from a tubing hanger central bore for landing on the orientation sleeve and rotationally oriented by the orientation sleeve to align the tubing hanger side port with the spool side port.

16. A system for drilling and completing a subsea production well as defined in claim 15, wherein the orientation sleeve includes an upper guide surface for engagement with the tubing hanger to orient the tubing hanger with respect to the tree.

* * * * *

UNITED STATES PATENT AND TRADEMARK OFFICE

CERTIFICATE OF CORRECTION

PATENT NO. : 6,988,553 B2
APPLICATION NO. : 10/872673
DATED : January 24, 2006
INVENTOR(S) : Blake T. DeBerry It is certified that error appears in the above-identified patent and that said Letters Patent is hereby corrected as shown below:

Column 10, line 4, change “claim 9” to --claim 10--

Column 10, line 9, change “claim 9” to --claim 10--

Colum 10, line 14, change “claim 9” to --claim 10--

Column 10, line 23, change “claim 9” to --claim 10--

Signed and Sealed this

Third Day of April, 2007

JON W. DUDAS
*Director of the United States Patent and Trademark Office*